US008364058B2

(12) United States Patent
Sato

(10) Patent No.: US 8,364,058 B2
(45) Date of Patent: Jan. 29, 2013

(54) PROCESS CARTRIDGES IN IMAGE FORMING DEVICE

(75) Inventor: Shougo Sato, Seto (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 579 days.

(21) Appl. No.: 12/549,647

(22) Filed: Aug. 28, 2009

(65) Prior Publication Data

US 2010/0054798 A1 Mar. 4, 2010

(30) Foreign Application Priority Data

Aug. 28, 2008 (JP) ..... 2008-220076

(51) Int. Cl.
*G03G 15/00* (2006.01)

(52) U.S. Cl. ..... 399/111; 399/117

(58) Field of Classification Search ..... 399/110–114, 399/116, 228, 262
See application file for complete search history.

(56) References Cited

U.S. PATENT DOCUMENTS

| | | | | |
|---|---|---|---|---|
| 6,029,027 | A | 2/2000 | Yokomori et al. | |
| 6,708,011 | B2 | 3/2004 | Nomura et al. | |
| 7,123,857 | B2 | 10/2006 | Harada et al. | |
| 2004/0126134 | A1 | 7/2004 | Harada et al. | |
| 2005/0047821 | A1 * | 3/2005 | Murayama et al. | 399/111 |
| 2007/0223971 | A1 * | 9/2007 | Takagi | 399/258 |
| 2008/0226331 | A1 * | 9/2008 | Allen et al. | 399/90 |

FOREIGN PATENT DOCUMENTS

| | | |
|---|---|---|
| JP | 10-105019 | 4/1998 |
| JP | 11-073010 | 3/1999 |
| JP | 2001-022248 | 1/2001 |
| JP | 2003-015378 | 1/2003 |
| JP | 2005-164764 | 6/2005 |
| JP | 2006-091932 | 4/2006 |
| JP | 2006-106474 | 4/2006 |
| JP | 2006-119462 | 5/2006 |
| JP | 2007-058057 | 3/2007 |

* cited by examiner

*Primary Examiner* — Walter L Lindsay, Jr.
*Assistant Examiner* — Jessica L Eley
(74) *Attorney, Agent, or Firm* — Banner & Witcoff, Ltd.

(57) ABSTRACT

An image forming device includes a process frame, and a process cartridge. The process cartridge is detachably insertable in the process frame in an inserting direction. The process cartridge includes a shutter unit. The shutter unit is pivotally movably supported to the cartridge body. The shutter unit includes an operating section and a shutter section. The operating section is abuttable on the process frame during insertion of the process cartridge into the process frame, and is pivotally movable in accordance with an insertion of the process cartridge into the process frame in the inserting direction. The shutter section is pivotally movable, in interlocking relation with the pivotal movement of the operating section, between a covering position covering a part of the outer peripheral surface of the photosensitive drum and an exposing position exposing the part of the outer peripheral surface to an atmosphere in accordance with the pivotal movement of the operating section.

15 Claims, 6 Drawing Sheets

13

PROCESS CARTRIDGES IN IMAGE FORMING DEVICE

CROSS REFERENCE TO RELATED APPLICATION

This application claims priority from Japanese Patent Application No. 2008-220076 filed Aug. 28, 2008. The entire content of each of these priority applications is incorporated herein by reference.

TECHNICAL FIELD

The invention relates to an image forming device, such as a color laser printer, and process cartridges mounted in the image-forming device.

BACKGROUND

A tandem-type color laser printer is well known in the art as an electrophotographic color laser printer having four photosensitive drums to correspond with four colors of toner; namely, yellow, magenta, cyan, and black. One example of such electrophotographic color laser printer has a device body, and an image-carrying-member cartridge that can be mounted in the device body, and a plurality of image-carrying members mounted in the cartridge so as to be positioned relative to each other.

SUMMARY

However, the image-carrying-member cartridge in the color image-forming device described above does not have parts for protecting the image-carrying members. Accordingly, the image-carrying members are always in an exposed state when removed from the image-carrying-member cartridge. Consequently, there is potential for the exposed image-carrying members to contact peripheral objects and become damaged when removed from the cartridge.

In view of the foregoing, it is an object of the invention to provide an image forming device capable of protecting photosensitive drums when process cartridges accommodating the photosensitive drums are removed from the image forming device. It is another object of the invention to provide process cartridges that are mounted in the image-forming device.

In order to attain the above and other objects, the invention provides an image forming device. The image forming device includes a main frame, a process frame, and a process cartridge. The process frame is mounted in the main frame and movable relative to the main frame. The process cartridge is detachably insertable in the process frame in an inserting direction. The process cartridge includes a cartridge body, a photosensitive drum, and a shutter unit. The photosensitive drum is supported to the cartridge body and has an outer peripheral surface. The shutter unit is pivotally movably supported to the cartridge body. The shutter unit includes an operating section and a shutter section. The operating section is abuttable on the process frame during insertion of the process cartridge into the process frame, and is pivotally movable in accordance with an insertion of the process cartridge into the process frame in the inserting direction. The shutter section is pivotally movable, in interlocking relation with the pivotal movement of the operating section, between a covering position covering a part of the outer peripheral surface of the photosensitive drum and an exposing position exposing the part of the outer peripheral surface to an atmosphere in accordance with the pivotal movement of the operating section. The covering position is provided prior to insertion of the process cartridge into the process frame, and the exposing position is provided upon insertion of the process cartridge into the process frame.

According to another aspect, the invention provides a process cartridge. The process cartridge includes a photosensitive drum, a pair of side plates, a developing unit, a driving force inputting portion, and a shutter unit. The photosensitive drum is rotatable about a rotational axis extending in an axial direction and has an outer peripheral surface. The pair of side plates opposes to each other at an interval and rotatably supports the photosensitive drum therebetween. The developing unit has one end and another end with respect to the axial direction and is supported between the pair of the side plates. The driving force inputting portion is provided in the one end of the developing unit for transmitting an external rotation force to the developing unit. The driving force inputting portion has a rotation center. The shutter unit is disposed between the pair of the side plates and is pivotally movable about the rotation center between a covering position covering a part of the outer peripheral surface and an exposing position exposing the part of the outer peripheral surface to an atmosphere.

BRIEF DESCRIPTION OF THE DRAWINGS

The particular features and advantages of the invention as well as other objects will become apparent from the following description taken in connection with the accompanying drawings, in which;

FIG. 5(*b*) is an explanatory diagram showing the process cartridge when the shutter is in an open position;

FIG. 6(*b*) is an explanatory diagram showing the shutter being moved from the closed position to the open position by pivoting the operating units; and FIG. 6(*c*) is an explanatory diagram showing the shutter in the open position with the engaging part fitted in a positioning groove.

DETAILED DESCRIPTION

1. Overall Structure of a Color Laser Printer

Figure 1:
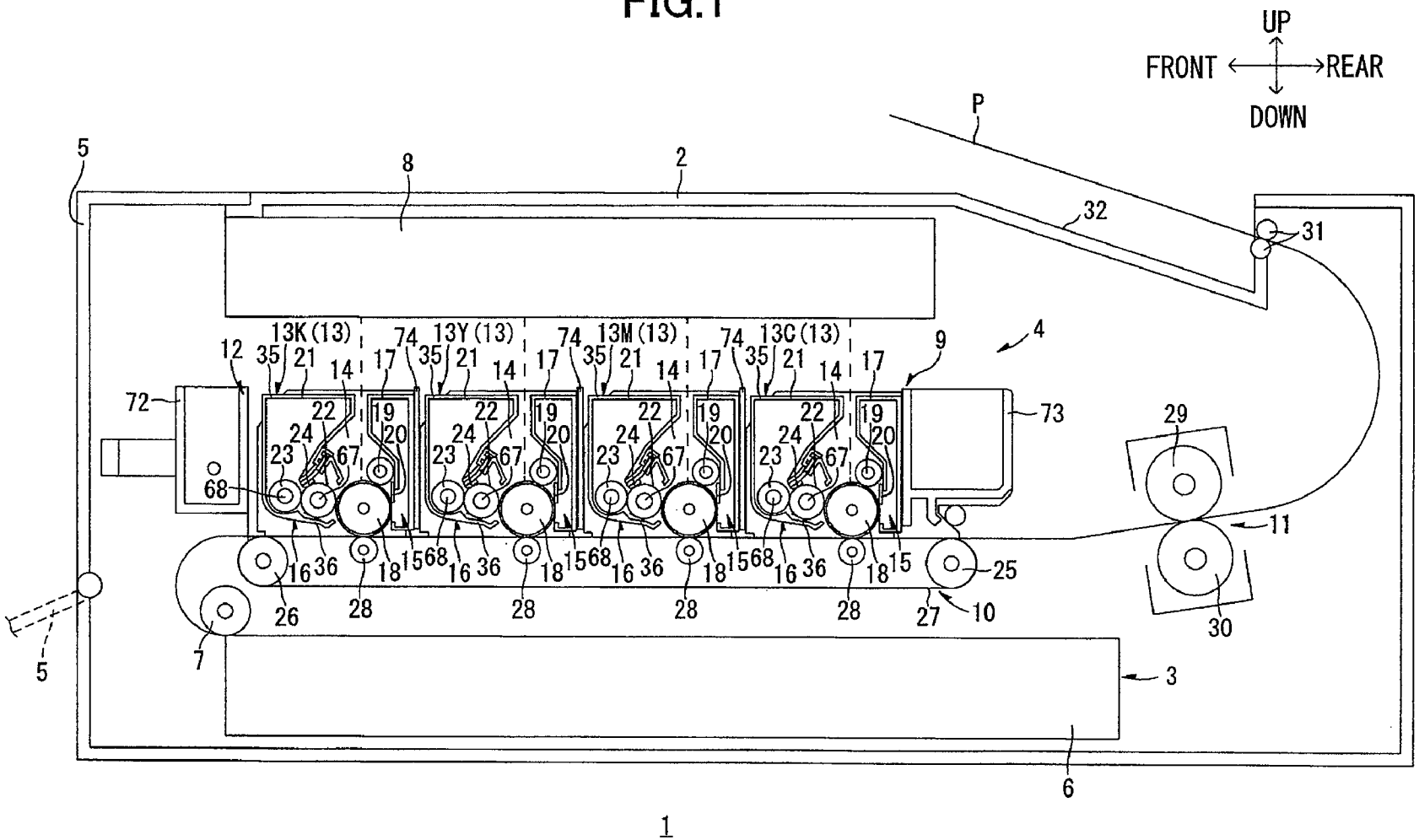
FIG. 1 is a side cross-sectional view of a color laser printer according to an embodiment.

FIG. 1 is a side cross-sectional view of a color laser printer 1 serving as an embodiment of the image-forming device according to the invention. The color laser printer 1 is a horizontal tandem-type color laser printer that includes a main casing 2 as the body of the printer and, within the main casing 2, a feeding unit 3 for supplying sheets of a paper P to be printed, and an image-forming unit 4 for forming images on the sheets of paper P supplied from the feeding unit 3.

(1) Main Casing

The main casing 2 has a box shape that is substantially rectangular in a side view. The image-forming unit 4 is accommodated in the main casing 2. A front cover 5 is provided on one side wall of the main casing 2 for exposing the inside of the main casing 2 in order to mount or remove a process frame 12 described later.

In the following description, the side of the color laser printer 1 on which the front cover 5 is provided will be referred to as the front side, and the opposite side as the rear side. The left and right sides of the color laser printer 1 will be based on a user's perspective when viewing the color laser printer 1 from the front. Hence, the near side of the color laser printer 1 in FIG. 1 is the right side, and the far side is the left side.

(2) Feeding Unit

The feeding unit 3 includes a paper tray 6 for accommodating sheets of the paper P. The paper tray 6 is detachably mounted in the bottom section of the main casing 2. A feeding roller 7 is disposed above the front end of the paper tray 6 for feeding sheets of paper P from the paper tray 6 to the image-forming unit 4 along a U-shaped feeding path (not shown).

The feeding roller 7 rotates to feed sheets of paper P accommodated in the paper tray 6 onto the feeding path one sheet at a time. The sheets of paper P are subsequently conveyed from the feeding path to the image-forming unit 4 so as to pass between four photosensitive drums 18 and a conveying belt 27 described later.

(3) Image-Forming Unit

The image-forming unit 4 includes a scanning unit 8, a process unit 9, a transfer unit 10, and a fixing unit 11.

(3-1) Scanning Unit

The scanning unit 8 is disposed above the main casing 2. The scanning unit 8 irradiates laser beams (dotted lines in FIG. 1) toward the four photosensitive drums 18 based on image data to expose the surfaces of the corresponding photosensitive drums 18.

(3-2) Process Unit

The process unit 9 is disposed below the scanning unit 8 and above the feeding unit 3. The process unit 9 includes the single process frame 12, and four process cartridges 13 corresponding to the four printing colors.

The process frame 12 can be inserted into or pulled out of the main casing 2 in the front-to-rear direction. The process cartridges 13 are detachably mounted in the process frame 12 in a juxtaposed arrangement in the front-to-rear direction. More specifically, the process cartridges 13 include a black process cartridge 13K, a yellow process cartridge 13Y, a magenta process cartridge 13M, and a cyan process cartridge 13C arranged from the front side to the rear side in the sequence given.

(3-2-1) Process Cartridges

Each process cartridge 13 is provided with a pair of left and right side walls 14, and a drum unit 15 and a developer unit 16 supported between the side walls 14. As will be described later in greater detail, the side walls 14 have a rectangular shape in a side view and are arranged opposite each other but separated in the left-to-right direction (see FIG. 2). Each drum unit 15 is disposed between the corresponding side walls 14 on the rear side thereof and includes a photosensitive drum 18, a charging roller 19, a cleaning box 17, and a cleaning blade 20.

The photosensitive drum 18 is oriented with its axis along the left-to-right direction and is rotatably supported between the side walls 14, with the bottom portion exposed.

The charging roller 19 is disposed diagonally above and rearward of the photosensitive drum 18 and confronts and contacts the photosensitive drum 18. The charging roller 19 is also rotatably supported between the side walls 14.

The cleaning box 17 is formed in a box shape extending vertically and is disposed on the rear side of the photosensitive drum 18 and the charging roller 19. The region of the cleaning box 17 opposing the photosensitive drum 18 is open.

The cleaning blade 20 is supported to the rear of the photosensitive drum 18 and contacts the photosensitive drum 18 near the opening formed in the cleaning box 17.

The developer unit 16 is disposed between the side walls 14 at the front side thereof and includes a developer casing 21 and, within the developer casing 21, a supply roller 23, a developing roller 22, and a thickness-regulating blade 24.

The developer casing 21 is integrally formed of a pair of left and right side walls 37 (see FIGS. 2 and 3), a toner chamber partitioning wall 35 (see FIGS. 2 and 3), and a roller supporting wall 36 (see FIG. 1). The toner chamber partitioning wall 35 and the roller supporting wall 36 span between the side walls 37.

Figure 3:
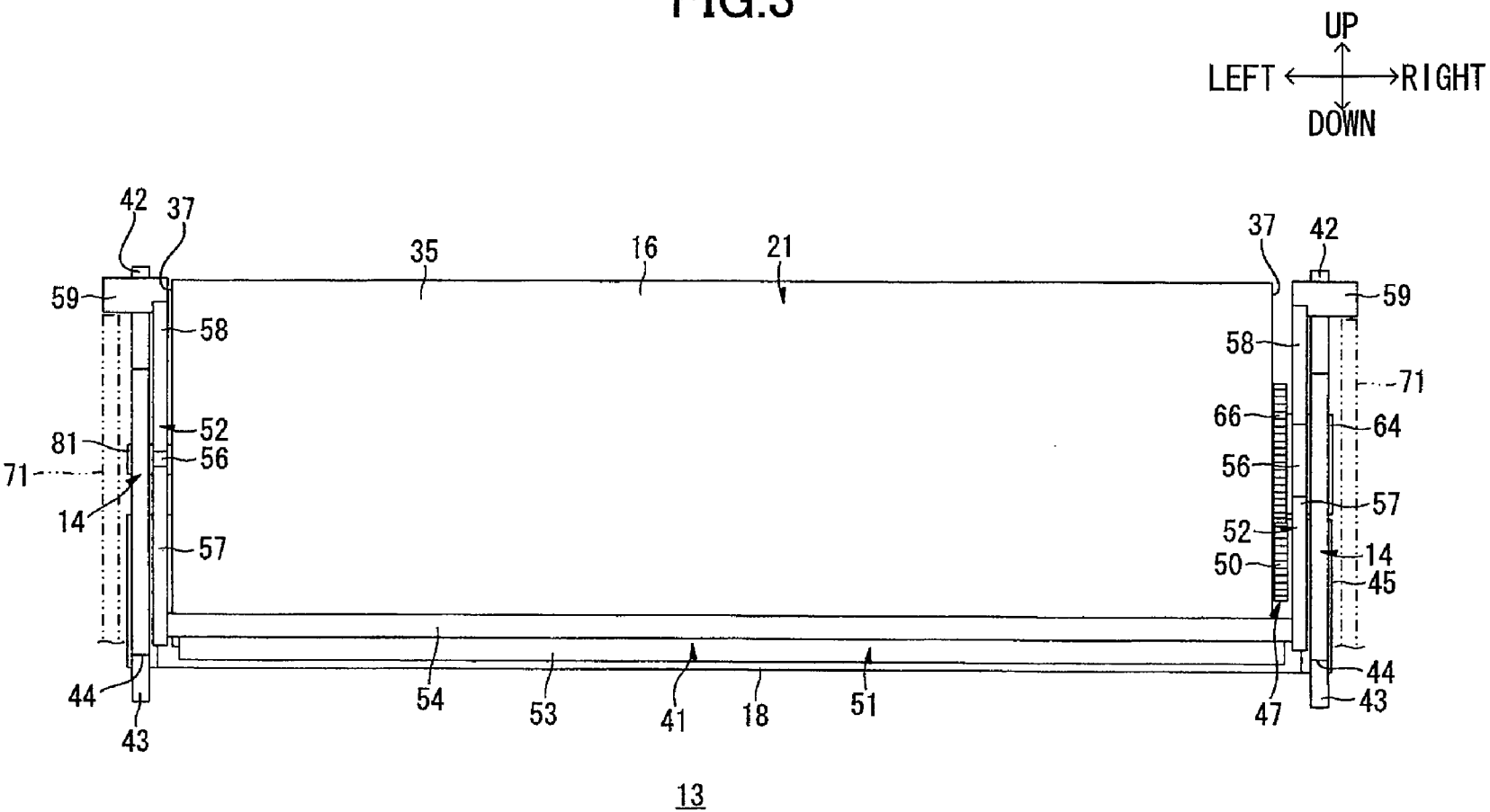
FIG. 3 is a front view of the process cartridge.

The side walls 37 are disposed on the insides of the side walls 14 and are separated in the direction in which the side walls 14 oppose each other (see FIG. 3).

As shown in FIG. 1, the toner chamber partitioning wall 35 includes a front wall extending vertically, a rear wall extending downward at a forward slope from the upper rear side, and a top wall linking the top edges of the front and rear walls, substantially forming a triangular shape in a side view with an opening in the lower end. Toner for the corresponding color of the process cartridge 13 is accommodated in the space defined by the toner chamber partitioning wall 35.

As shown in FIG. 1, the roller supporting wall 36 is a lip-like member formed continuously with the lower edge on the front wall of the toner chamber partitioning wall 35 and extending rearward so as to be separated vertically from the lower end on the rear wall of the toner chamber partitioning wall 35.

Accordingly, the developer casing 21 is formed in a box shape with an opening on the lower end facing rearward.

The developing roller 22 is disposed in the roller supporting wall 36 so as to contact the photosensitive drum 18 and is exposed from the rear side of the developer casing 21. The developing roller 22 includes a developing roller shaft 67 that is covered with a rubber roller. The developing roller shaft 67 is rotatably supported in the side walls 37 (see FIG. 3).

The supply roller 23 is disposed in the roller supporting wall 36 on the front side of the developing roller 22. The supply roller 23 includes a supply roller shaft 68 that is covered with a sponge roller. The supply roller shaft 68 is rotatably supported in the side walls 37 (see FIG. 3).

The thickness-regulating blade 24 is disposed above the developing roller 22 and is supported on the rear wall of the toner chamber partitioning wall 35.

(3-2-2) Developing Operations of the Process Cartridge

Toner accommodated in the space defined by the toner chamber partitioning wall 35 is supplied onto the supply roller 23, which in turn supplies toner to the developing roller 22. At the same time, the toner is positively tribocharged between the supply roller 23 and developing roller 22.

As the developing roller 22 rotates, the thickness-regulating blade 24 regulates the toner carried on the surface of the developing roller 22 to a prescribed thickness so that the developing roller 22 carries a uniform thin layer of toner.

In the meantime, the charging roller 19 applies a uniform positive charge to the surface of the photosensitive drum 18 while the photosensitive drum 18 rotates. Subsequently, the scanning unit 8 irradiates a laser beam (see the dotted lines in FIG. 1) through the gap formed between the cleaning box 17 and developer casing 21 to expose the surface of the photosensitive drum 18 in a high-speed scan. In this way, the scanning unit 8 forms an electrostatic latent image on the surface of the photosensitive drum 18 corresponding to an image to be formed on the paper P.

As the photosensitive drum 18 continues to rotate, the positively charged toner carried on the surface of the developing roller 22 is supplied to the electrostatic latent image formed on the surface of the photosensitive drum 18, thereby developing the electrostatic latent image into a visible toner image through reverse development.

After a transfer operation, any toner remaining on the surface of the photosensitive drum 18 is subsequently scraped off the photosensitive drum 18 by the cleaning blade 20 and collected in the cleaning box 17.

(3-3) Transfer Unit

The transfer unit 10 is disposed in the main casing 2 above the feeding unit 3 and below the process unit 9 and extends in the front-to-rear direction. The transfer unit 10 includes a drive roller 25, a follow roller 26, the conveying belt 27 mounted over the drive roller 25 and follow roller 26, and four transfer rollers 28. The conveying belt 27 is an endless belt.

The drive roller 25 and the follow roller 26 are parallel to each other and separated in the front-to-rear direction. The conveying belt 27 is mounted around the drive roller 25 and follow roller 26. The transfer rollers 28 are disposed inside the conveying belt 27 at positions opposing the photosensitive drums 18 with the conveying belt 27 interposed therebetween. Position between the photosensitive drum 18 and the corresponding transfer roller 28 is referred to as a transfer position.

The upper portion of the conveying belt 27 moves rearward for conveying a sheet of paper P supplied from the feeding unit 3 sequentially through each transfer position between the photosensitive drums 18 and transfer rollers 28. As the sheet is conveyed on the conveying belt 27, toner images of each color carried on the respective photosensitive drums 18 are sequentially transferred onto the sheet to form a color image.

(3-4) Fixing Unit

The fixing unit 11 is disposed to the rear of the transfer unit 10 and includes a heating roller 29, and a pressure roller 30 in confrontation with the heating roller 29. After a color image has been transferred onto the sheet of paper P in the transfer unit 10, the image is fixed to the sheet by a combination of heat and pressure as the sheet passes between the heating roller 29 and the pressure roller 30 in the fixing unit 11.

(4) Discharge Section

After the toner image has been fixed to the paper P, the sheet is conveyed along a U-shaped discharge path (not shown) toward a pair of discharge rollers 31 disposed at the downstream end of the path. The discharge rollers 31 discharge the sheet onto a discharge tray 32 formed on the top surface of the main casing 2.

Figure 2:
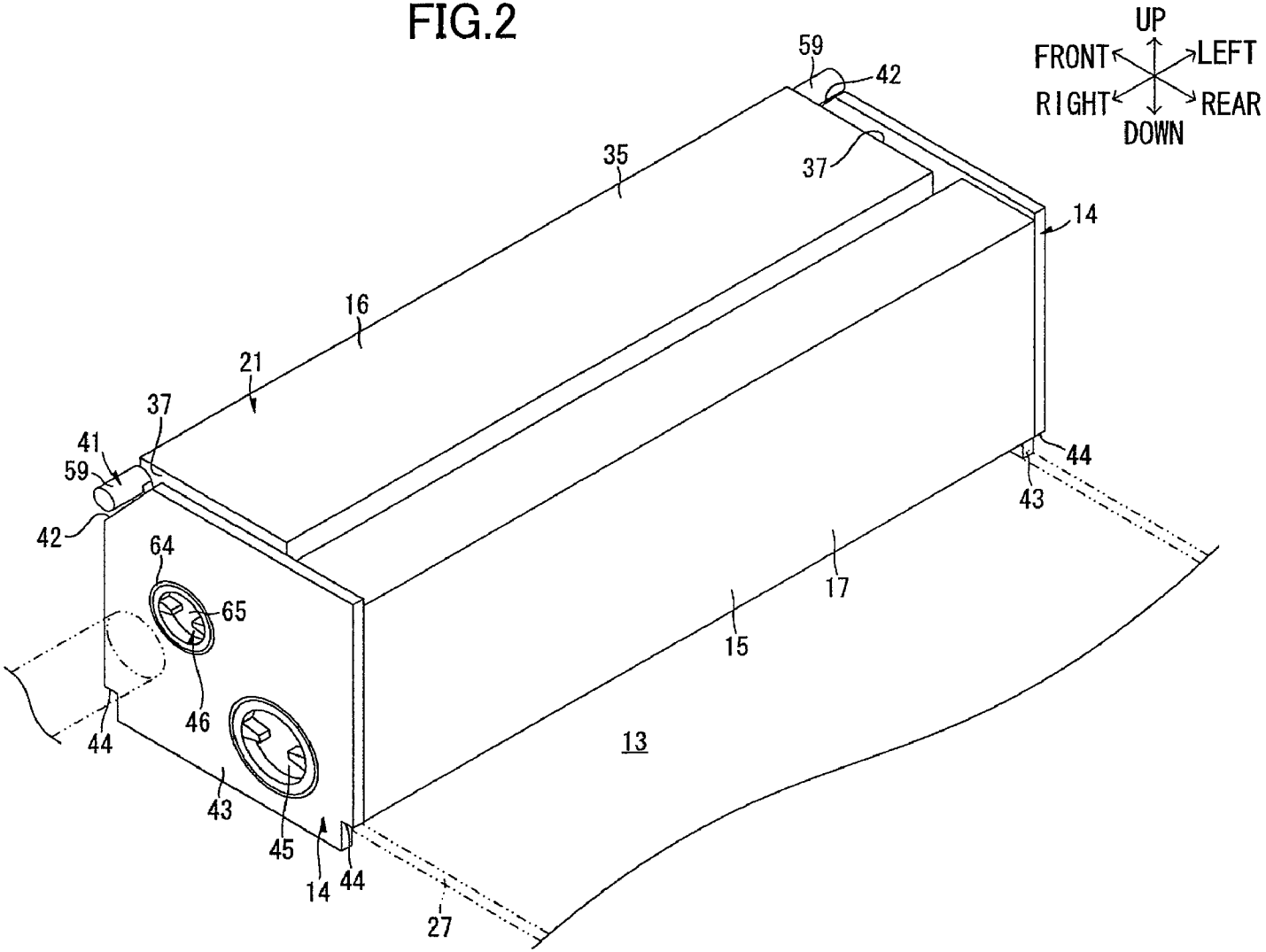
FIG. 2 is a perspective view of one of process cartridges shown in FIG. 1.
Figure 4:
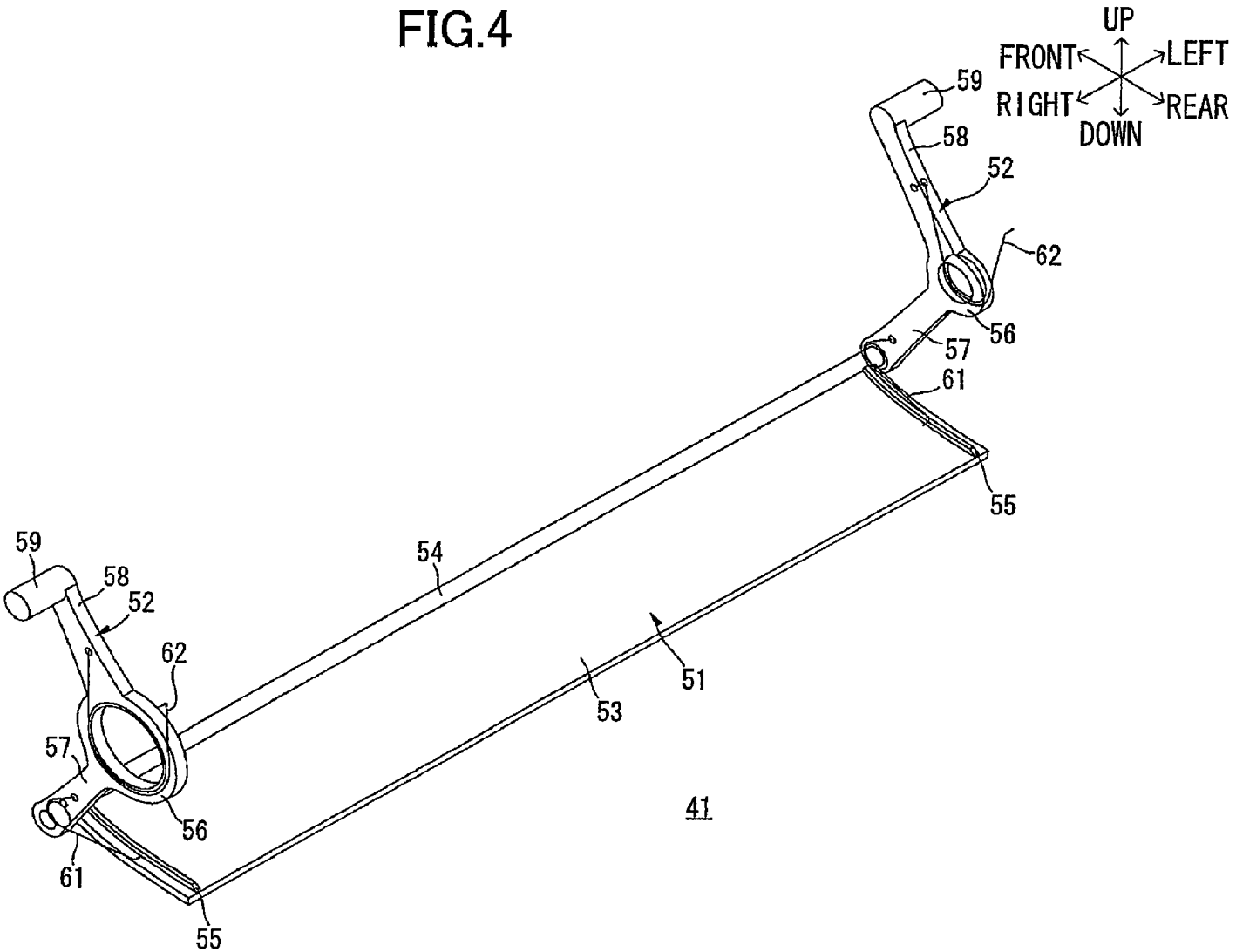
FIG. 4 is a perspective view of a shutter shown in FIG. 3.
Figure 5A:
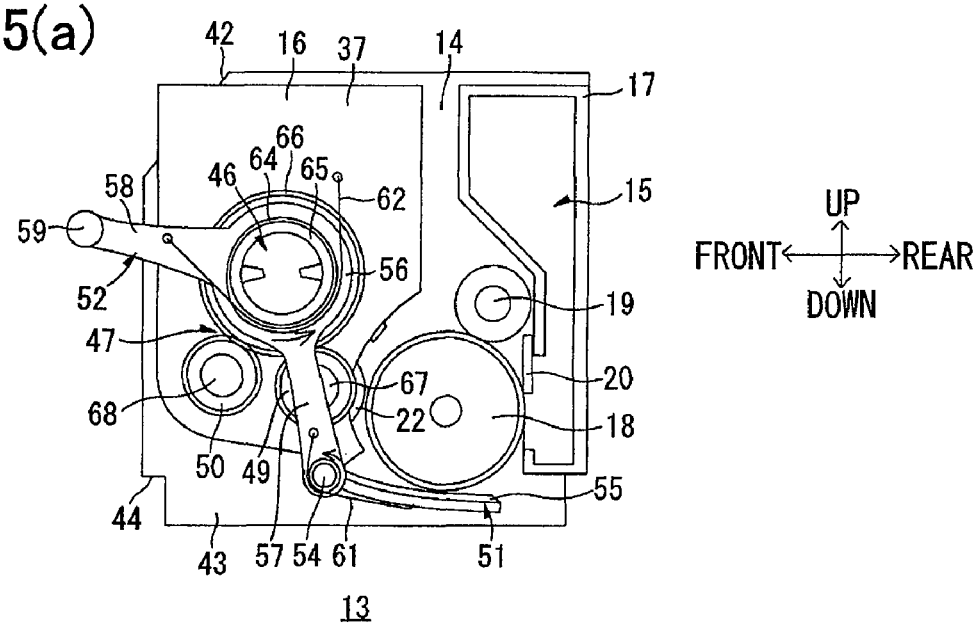
FIG. 5(*a*) is an explanatory diagram showing the process cartridge when the shutter is in a closed position.
Figure 5B:
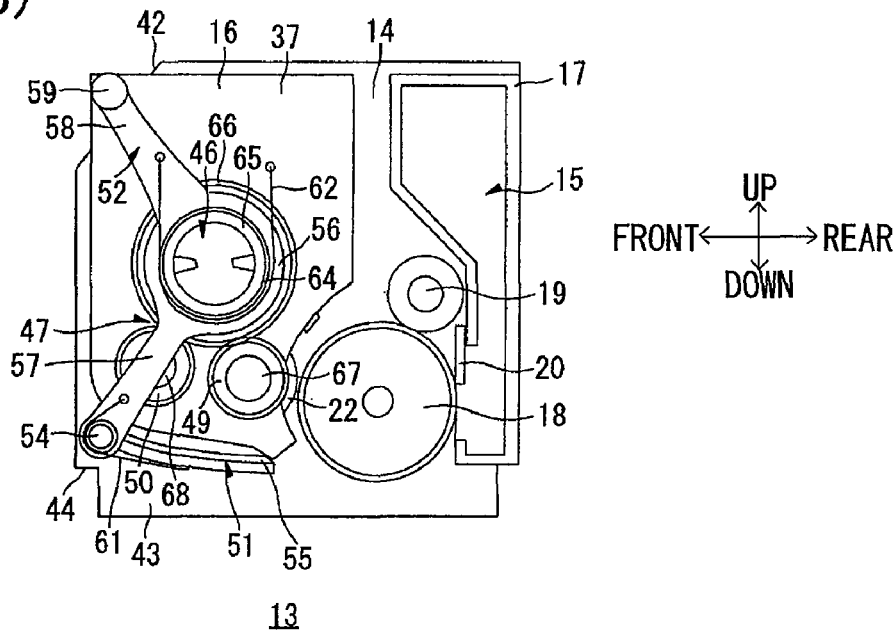

2. Detailed Description of the Process Unit (1) Detailed Description of the Process Cartridges FIG. 2 is a perspective view of one of the process cartridges 13 shown in FIG. 1. FIG. 3 is a front view of the process cartridge 13. FIG. 4 is a perspective view of a shutter shown in FIG. 3. FIG. 5(*a*) shows the process cartridge 13 when the shutter is in a closed position, and FIG. 5(*b*) shows the process cartridge 13 when the shutter is in an open position.

As shown in FIG. 2, the cleaning box 17 of the process cartridge 13 is disposed on the rear side between the side walls 14, while the developer casing 21 is disposed on the front side between the side walls 14. The cleaning box 17 is fixed to both side walls 14. As shown in FIGS. 3 and 5(*a*), on the right side walls 37, the developer casing 21 includes a developer coupling 46, and a gear train 47 engaged with the developer coupling 46.

The developer coupling 46 includes a coupling gear 66, a coupling joint 65, and a coupling cover 64. The coupling gear 66 is disposed in and rotatably supported by the right side wall 37 at a position substantially in the center thereof with respect to both the front-to-rear and vertical directions.

The coupling joint 65 is integrally formed with the coupling gear 66 and thus rotates together with the coupling gear 66. The coupling joint 65 is oriented with its axis along the left-to-right direction and protrudes rightward from the right side wall 37.

The coupling cover 64 is cylindrical in shape and fits around the coupling joint 65. The coupling cover 64 protrudes rightward from the side wall 37 so as to expose the coupling gear 66.

The gear train 47 includes a developing roller drive gear 49 and a supply roller drive gear 50 that are engaged with the coupling gear 66.

The developing roller drive gear 49 is fixed to the right end of the developing roller shaft 67 that protrudes rightward from the right side wall 37. The supply roller drive gear 50 is fixed to the right end of the supply roller shaft 68 that protrudes rightward from the right side wall 37.

As will be described later, when the process cartridge 13 is mounted in the main casing 2, an input-side joint (not shown) that is capable of advancing or retracting in the left-to-right direction advances into the coupling joint 65, is connected to the coupling joint 65 so as to prevent the input-side joint (not shown) from rotating relative to the coupling joint 65.

A motor (not shown) is provided in the main casing 2 for producing a drive force that is transmitted to the input-side joint (not shown). The drive force transmitted from the motor is inputted into the coupling joint 65 via this input-side joint (not shown). At this time, the coupling gear 66 rotates together with the coupling joint 65. The developing roller drive gear 49 and the supply roller drive gear 50 that are engaged with the coupling gear 66 also rotate, thereby driving the developing roller 22 and supply roller 23 to rotate. The developer coupling 46 and the gear train 47 transmit an external rotation force to the developing roller 22 and the photosensitive drum 18.

As shown in FIG. 3, a protruding support part 81 is provided on the left side wall 37 of the developer casing 21. The protruding support part 81 has a columnar shape and a center axis aligned with the center axis of the coupling joint 65 in the left-to-right direction. The protruding support part 81 protrudes leftward from the left side wall 37.

The developer coupling 46 (coupling cover 64) penetrates the right side wall 14 in the left-to-right direction and is rotatably supported thereby. The protruding support part 81 penetrates the left side wall 14 in the left-to-right direction and is rotatably supported thereby.

Hence, the developer casing 21 is supported by both side walls 14 while being separated from each side wall 14 by a gap in the left-to-right direction. As shown in FIG. 2, the side walls 14 are disposed outside the conveying belt 27 in a width direction orthogonal to the moving direction of the conveying belt 27. The side walls 14 are substantially rectangular in shape in a side view and arranged parallel to each other while separated in the left-to-right direction. Hence, when the process cartridge 13 is mounted, the photosensitive drum 18 can be placed in contact with the conveying belt 27 between the side walls 14.

Foot parts 43 are provided on the bottoms of the side walls 14 and extend lower than the bottom edges of the cleaning box 17 and developer casing 21. The foot parts 43 are rectangular in shape in a side view and are narrower in the front-to-rear direction than the upper portions of the side walls 14. The foot parts 43 are formed by cutting out step parts 44 in the lower front and rear corners of each side wall 14 so that the inner bottom surfaces of the step parts 44 are flush with the bottom surface of the cleaning box 17 in a horizontal plane.

A cutout part 42 is formed in the top front corner of each side wall 14. The cutout part 42 is cut at a slant that slopes downward and forward from the top edge of the side wall 14 to the front edge thereof.

A drum coupling 45 is provided on the right side wall 14 for inputting a drive force from a motor (not shown) to the photosensitive drum 18 (see FIG. 2).

A shutter 41 is provided between the side walls 14. As shown in FIG. 4, the shutter 41 includes a cover member 51, and a pair of left and right support members 52 supporting the cover member 51.

The cover member 51 is integrally provided with a cover plate 53, a pivoting shaft 54, and guide rails 55.

The cover plate 53 is plate-shaped and extends in the left-to-right direction. In a cross-sectional view, the cover plate 53 has a curved shape with a downwardly depressed center.

The pivoting shaft 54 is rod-shaped with a greater left-to-right length than the left-to-right length of the cover plate 53. The pivoting shaft 54 is provided on the front edge of the cover plate 53 and extends in the left-to-right direction. The left and right ends of the pivoting shaft 54 protrude farther in the left and right directions than the left and right edges of the cover plate 53.

The guide rails 55 are formed on the left and right edges of the cover plate 53, protruding upward from the top surface of the cover plate 53. The guide rails 55 are disposed so that their top edges contact the photosensitive drum 18 at positions on the left and right outside the region through which a sheet of paper P passes. Placing the left and right guide rails 55 in contact with the photosensitive drum 18 prevent the cover plate 53 from directly contacting the region of the photosensitive drum 18 through which a sheet of paper P passes.

Each support members 52 is integrally provided with a support part 56, an arm part 57, an operating part 58, and an engaging part 59.

The support part 56 has an annular shape in a side view. The right support part 56 has a slightly larger diameter than that of the coupling cover 64 provided on the developer coupling 46. The left support part 56 has a slightly larger diameter than that of the protruding support part 81.

The arm part 57 is formed continuously with the support part 56 and extends radially outward from the support part 56. A through-hole is formed in the arm part 57 at the distal end opposite the support part 56. The ends of the pivoting shaft 54 provided in the cover member 51 are inserted through the through-holes of the arm parts 57 and are capable of rotating relative to the arm parts 57. Hence, the arm parts 57 pivotably support the left and right ends of the cover member 51. From this configuration, the cover member 51 is suspended from the support part 56, and the operating part 58 extends from the support part 56.

Each operating part 58 is formed continuously with the corresponding support part 56 and extends radially outward from the support part 56 so as to form an angle of about 120 degrees with the arm part 57. In other words, the relative positions of the operating part 58 and the arm part 57 are permanently fixed at an angle of about 120 degrees.

The engaging part 59 is disposed on the free end of the operating part 58 opposite the support part 56 and has a columnar shape that protrudes outward in the left or right direction.

As shown in FIGS. 3 and 4, the right support member 52 fits over the coupling cover 64 between the right side wall 14 and the right side wall 37 of the developer unit 16 and is capable of rotating relative to the coupling cover 64. Similarly, the left support member 52 is fitted over the protruding support part 81 between the left side wall 14 and the left side wall 37 of the developer unit 16 and is capable of rotating relative to the protruding support part 81. Accordingly, the shutter 41 is supported on the developer casing 21 so as to be capable of pivoting about the center axes of the developer coupling 46 and the protruding support part 81 (i.e., the rotational center of the coupling joint 65).

With this construction, the support part 56, the arm part 57, and the operating part 58 of the left support member 52 are disposed between the left side wall 14 and the left side wall 37 of the developer unit 16. Similarly, the support part 56, the arm part 57, and the operating part 58 of the right support member 52 are disposed between the right side wall 14 and the gear train 47 provided on the right side wall 37 of the developer unit 16. That is, the arm parts 57 of the shutter 41 support both left and right ends of the cover member 51 and are coupled with one of the developer coupling 46 and the protruding support part 81. The arm parts 57 are disposed between each of the side walls 14 and the developer unit 16 with respect to the axial direction of the photosensitive drum 18 (left-to-right direction). Hence, the space between the side walls 14 and the developer unit 16 can be used to dispose the arm parts 57, without having to provide additional space in the process cartridge 13. As a result, the shutter 41 is compactly provided in the process cartridge 13.

The shutter 41 also includes a pair of left and right first torsion springs 61, and a pair of left and right second torsion springs 62. As shown in FIG. 4, each first torsion spring 61 is wound around the pivoting shaft 54 of the cover member 51, and has one end engaged with the arm part 57 of the support member 52 and the other end engaged with the cover plate 53 of the cover member 51. Through the urging force of the first torsion springs 61, the cover member 51 is constantly urged in a counterclockwise direction when viewed from the right about the pivoting shaft 54.

The second torsion springs 62 are respectively wound about the protruding support part 81 and the developer coupling 46, and have one end engaged with the operating part 58 of the support member 52 and the other end engaged with the side wall 14. Through the urging force of the second torsion springs 62, the shutter 41 is constantly urged in a counterclockwise direction when viewed from the right about the rotational center of the coupling joint 65.

The shutter 41 moves between the closed position shown in FIG. 5(*a*) for covering the photosensitive drum 18 and the open position shown in FIG. 5(*b*) for exposing the photosensitive drum 18 by pivoting about the rotational center of the coupling joint 65.

Since the shutter 41 pivots about the rotational center of the coupling joint 65, this configuration prevents the shutter 41 from interfering with the drive force inputted into the developer unit 16, even while the shutter 41 moves from the closed position to the open position. As a result, the shutter 41 can move from the closed position to the open position without interfering with the drive force inputted into the developer unit 16 and can protect the photosensitive drum 18 when moved into the closed position.

When the shutter 41 is in the closed position shown in FIG. 5(*a*), the cover member 51 is advanced below the photosensitive drum 18 so that the guide rails 55 contact the photosensitive drum 18 outside the paper-conveying region, thereby covering the photosensitive drum 18. Further, the bottom edge of the cover member 51 is positioned above the bottom edge of the side walls 14. In other words, the cover member 51 is accommodated in a region formed by projecting the side walls 14 in the left-to-right direction. That is, each side walls 14 have the outer major surface extending in a plane perpendicular to the left-to-right direction and the cover member 51 is positioned within a contour of the major surface at the close position.

The operating parts 58 protrude forward from the front edges of the side walls 14. In other words, the operating parts 58 project farther forward than the region formed by projecting the side walls 14 in the left-to-right direction.

When the shutter 41 is in the open position shown in FIG. 5(*b*), the cover member 51 is retracted to the space beneath the developer unit 16, thereby opposing the developer unit 16 vertically and exposing the photosensitive drum 18. In other words, the cover member 51 is in direct confrontation with the developing unit 16 at the open position. Hence, the space below the developer unit 16 can be used for placing the shutter 41 in the open position. As a result, the process cartridge 13 can be made compact when the shutter 41 is in the open position. Further, the operating parts 58 are rotated such that the engaging parts 59 are retracted into the cutout parts 42.

Further, when the shutter 41 is in the open position, at least both of a part of the developing roller 22 and a part of the supply roller 23 are encompassed in a region formed by projecting, in the vertical direction, the cover member 51 toward the developer unit 16.

(2) Detailed Description of the Process Frame

Figure 6A:
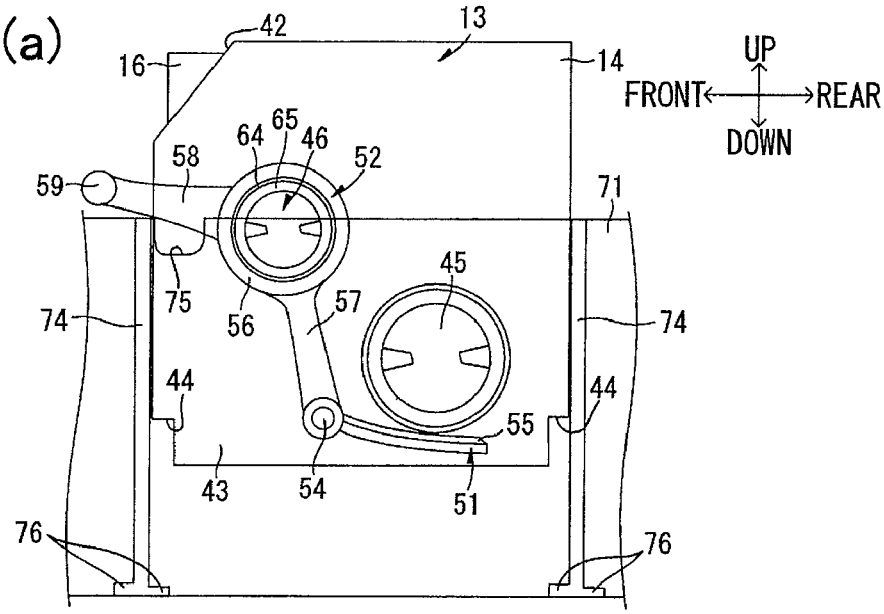
FIG. 6(*a*) is an explanatory diagram showing the shutter in the closed position and an operating unit contacting a positioning plate.
Figure 6B:
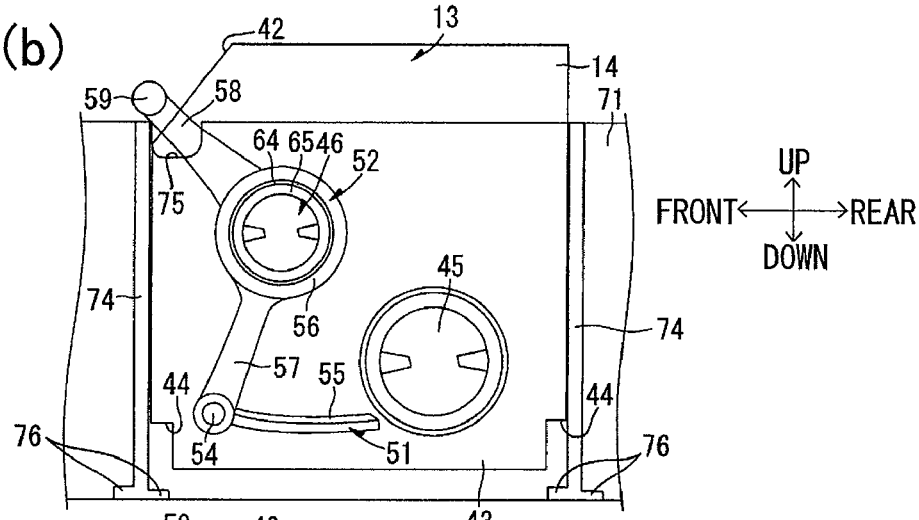
Figure 6C:
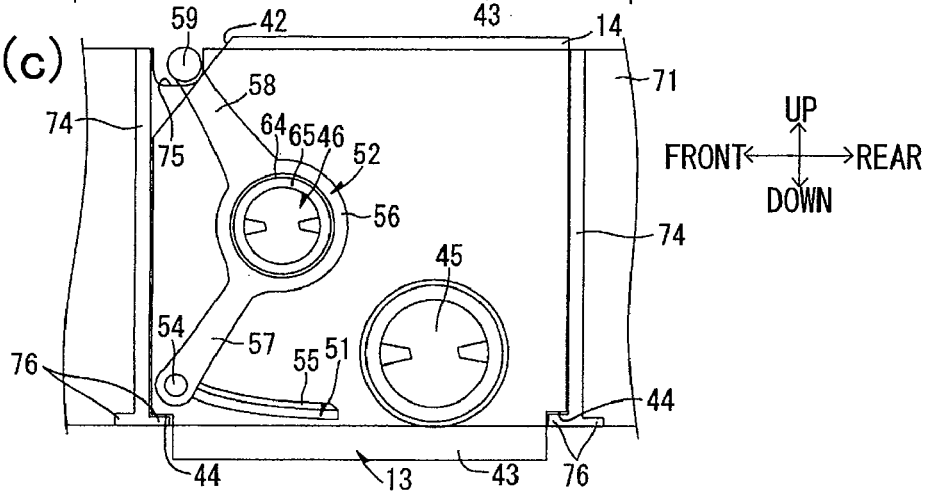

FIGS. 6(*a*), 6(*b*) are explanatory diagrams illustrating the operation for mounting a process cartridge in the process frame. FIG. 6(*a*) shows the shutter in the closed position and the operating unit contacting a positioning plate. FIG. 6(*b*) shows the shutter being moved from the closed position to the open position by pivoting the operating units. FIG. 6(*c*) shows the shutter in the open position with the engaging part fitted in a positioning groove.

The process frame 12 is formed of a hard resin in a frame-like shape for accommodating the four process cartridges 13. As shown in FIG. 1, the process frame 12 is integrally provided with a pair of left and right frame side walls 71 (see FIG. 3), a front beam 72, a rear beam 73, and a plurality of positioning plates 74.

The frame side walls 71 are arranged parallel to each other on the left and right sides of the four process cartridges 13 and extend in the front-to-rear and vertical directions. As shown in FIG. 6(*a*), four positioning grooves 75 are formed as cutout parts in the top edge of each frame side wall 71.

More specifically, the positioning grooves 75 are provided at positions corresponding to the front ends of the process cartridges 13 adjacent to the positioning plates 74 when the process cartridges 13 are mounted in the process frame 12. That is, each positioning groove 75 is located at the top edge of each frame side wall 71 and rear side of each positioning plate 74. The positioning grooves 75 are substantially U-shaped in a side view and open on the top for receiving the engaging parts 59 of the shutter 41.

As shown in FIG. 1, the front beam 72 is substantially U-shaped in a cross-sectional view and extends in the left-to-right direction, spanning between the front ends of the frame side walls 71. That is, the front beam 72 has a front wall, a rear wall and a bottom wall that connects the front wall and the rear wall.

The rear beam 73 is substantially U-shaped in a cross-sectional view and extends in the left-to-right direction, spanning between the rear ends of the frame side walls 71.

Three of the positioning plates 74 span between the frame side walls 71 at regular intervals between the front beam 72 and the rear beam 73. The positioning plates 74 extend vertically and in the left-to-right direction, with left and right edges formed continuously with the frame side walls 71.

With this construction, the space defined by the front beam 72, the rear beam 73, and the pair of left and right frame side walls 71 is divided by the three positioning plates 74 into four equal spaces in the front-to-rear direction.

In addition, as shown in FIG. 6(*a*), protrusions 76 are provided on both left and right ends on the bottom edges of the positioning plates 74. Each protrusion 76 protrudes in the front and rear directions from the corresponding positioning plate 74. As shown in FIG. 6(*c*), the protrusions 76 contact the step parts 44 of the side walls 14 in the process cartridge 13 and are positioned outside the conveying belt 27 with respect to the width direction of the conveying belt 27 orthogonal to the moving direction of the conveying belt 27.

3. Operation for Mounting a Process Cartridge

To mount the process cartridges 13 in the main casing 2, first the operator pulls the process frame 12 out of the main casing 2 and mounts the process cartridges 13 in the process frame 12.

To mount a process cartridge 13 in the process frame 12, the operator aligns the front and rear edges of the side wall 14 with the front and rear positioning plates 74 (in the cases of the black process cartridge 13K and the cyan process cartridge 13C, either the front or rear positioning plate 74) above the process frame 12, as shown in FIG. 6(*a*), and inserts the process cartridge 13 downward into the process frame 12.

When inserting the process cartridge 13 (the process cartridges 13Y, 13M and 13C), the operating parts 58 contact the top edge of the positioning plate 74. As the operator pushes the process cartridge 13 farther down into the process frame 12, the operating parts 58 receive an upward reaction force from the positioning plate 74 and begins to pivot upward against the urging force of the second torsion springs 62. Simultaneously, the arm parts 57 begin to pivot in the forward direction. Similarly to the process cartridges 13Y, 13M, and 13C, when inserting the process cartridge 13K, the operating part 58 contacts the top edge of the rear wall of the front beam 72.

As a result, the cover member 51 is pulled in the forward direction and begins to move from a position beneath the photosensitive drum 18 to a position beneath the developer unit 16. As the cover member 51 moves in this way, the guide rails 55 slide along the peripheral surface of the photosensitive drum 18 through the urging force of the first torsion springs 61.

Subsequently when the operator continues to insert the process cartridge 13, as shown in FIG. 6(*b*), the cover member 51 separates from the photosensitive drum 18, leaving the photosensitive drum 18 exposed.

In other words, the support part 56 is pivotally movable about the rotation center of the coupling joint 65 to provide pivotal movement of the cover member 51 and pivotal movement of the operating part 58 about the rotation center of the coupling joint 65. The operating part 58 is pivotally movable to an upstream side in the inserting direction after the abutment of the operating part 58 onto the process frame 12 for moving the cover member 51 toward the open position.

Further, when the operator continues to insert the process cartridge 13, as shown in FIG. 6(*c*), the engaging parts 59 engage in the positioning grooves 75, fixing the shutter 41 in the open position. In other words, the cutout parts 42 accommodate the engaging parts 59 when the cover member 51 is located at the open position to maintain the open position. At this time, the engaging parts 59 are retracted into the cutout parts 42. At the same time, the step parts 44 of the process cartridge 13 contact the protrusions 76 of the process frame 12, restricting further downward movement of the process cartridge 13. This completes the process to mount the process cartridge 13 in the process frame 12.

In other words, the operating parts 58 are abuttable on the process frame 12 during insertion of the process cartridge 13 into the process frame 12, and pivotally movable in accordance with an insertion of the process cartridge 13 into the process frame 12 in the vertical direction. The shutter 41 is pivotally movable, in interlocking relation with the pivotal movement of the operating section, between the closed position covering the outer peripheral surface of the photosensitive drum 18 and the open position exposing the outer peripheral surface to an atmosphere in accordance with the pivotal movement of the operating parts 58. The closed position is provided prior to insertion of the process cartridge 13 into the process frame 12, and the open position is provided upon insertion of the process cartridge 13 into the process frame 12.

As a result, the shutter 41 can be kept in the closed position to protect the photosensitive drum 18 until the process cartridge 13 is mounted in the process frame 12. The shutter 41 moves into the open position to expose the photosensitive drum 18 in association with the operation to mount the process cartridge 13 into the process frame 12.

When the process cartridge is mounted in the process frame 12, the front surface of the process cartridge 13 confronts the rear surfaces of the positioning plates 74 in the front-to-rear direction, and the operating parts 58 are positioned farther rearward (toward the developer unit 16) than the positioning plate 74. Therefore, the operating parts 58 can be accommodated in the process frame 12 when viewed vertically. Further, the left and right outer surfaces of the engaging parts 59 are flush with the left and right outer surfaces of the frame side walls 71 (see FIG. 3). After the process cartridges 13 have been mounted in the process frame 12, the operator pushes the process frame 12 rearward into the main casing 2 until the process frame 12 is in its originally mounted state in the main casing 2. Thus, the operation for mounting the process cartridges 13 in the main casing 2 is complete.

As shown in FIG. 6(*b*), when the process cartridge 13 is mounted downward into the process frame 12, the operating parts 58 contact the positioning plate 74 of the process frame 12 and pivot upward. That is, the operating parts 58 are retractable toward the developing unit 16 from the positioning plate 74 upon insertion of the process cartridge 13 into the process frame 12. Accordingly, the positioning plate 74 of the process frame 12 is used to pivot the operating parts 58 and move the shutter 41 into the open position. Hence, the shutter 41 can be reliably moved into the open position through a simple construction.

Hence, the engaging parts 59 are accommodated in the positioning grooves 75 of the process frame 12 after the process cartridge 13 is mounted in the process frame 12, resulting in a more compact construction of the process frame 12 when the process cartridges 13 are mounted therein.

When the process cartridge 13 is mounted in the process frame 12, the operating parts 58 are disposed farther inward from the outer surface of the frame side walls 71 with respect to the axial direction of the photosensitive drum 18 (i.e., the left-to-right direction). That is, the operating part 58 is positioned inside of an imaginary space spanning between outer side surfaces of the pair of frame side walls 71 upon insertion of the process cartridge 13 into the process frame 12.

Accordingly, the operating parts 58 can be accommodated in the process frame 12 with respect to the left-to-right direction, making the process frame 12 more compact both in the vertical and left-to-right directions when the process cartridges 13 are mounted therein.

As illustrated in FIGS. 5(*a*), 5(*b*), the process cartridge 13 of the embodiment is provided with the shutter 41 that moves between the closed position for covering the photosensitive drum 18 and the open position for exposing the photosensitive drum 18. Hence, the shutter 41 can cover and protect the photosensitive drum 18 in the closed position and can expose the photosensitive drum 18 in the open position.

Further, as illustrated in FIGS. 5(*a*), 5(*b*), the shutter 41 is supported so as to be capable of pivoting about a rotational center of the coupling joint 65, which transmits a drive force from a motor (not shown) provided in the main casing 2.

Since the shutter 41 pivots about the rotational center of the coupling joint 65, this configuration prevents the shutter 41 from interfering with the drive force inputted into the developer unit 16, even while the shutter 41 moves from the closed position to the open position. As a result, the shutter 41 can move from the closed position to the open position without interfering with the drive force inputted into the developer unit 16 and can protect the photosensitive drum 18 when moved into the closed position.

Further, as shown in FIG. 3, in the process cartridge 13 according to the embodiment, the right arm part 57 passes between the side wall 14 and the gear train 47 on the right side of the developer unit 16.

Hence, the space between the side wall 14 and the gear train 47 on the right side of the developer unit 16 can be used to dispose the arm part 57 without interfering with the drive force transmitted to the developer coupling 46 and gear train 47. As a result, the shutter 41 can be compactly provided in the process cartridge 13 while maintaining freedom in the design of the developer unit 16 for the drive force transmission path.

Further, with the process cartridge 13 of the embodiment, the cover member 51 is accommodated in a region formed by projecting the side walls 14 in the left-to-right direction when the shutter 41 is in the closed position shown in FIG. 5(*a*).

Accordingly, the process cartridge 13 can be made compact when the shutter 41 is in the closed position as well. In addition, when the process cartridge 13 is removed and placed on a flat surface, the shutter 41 disposed in the closed position does not contact the flat surface. Hence, the process cartridge 13 can be safely placed on a flat surface when the shutter 41 is in the closed position.

With the process cartridge 13 of the embodiment, the operating parts 58 protrude out of the region formed by projecting the side walls 14 in the left-to-right direction. In other words, each side walls 14 have the outer major surface extending in a plane perpendicular to the left-to-right direction. The part of the operating part 58 is protruding outward from a contour of the major surface of the side wall 14 so that the operating part 58 is abuttable on the process frame 12 separate from the process cartridge 13. Pivotal movement of the operating part 58 causes pivotal movement of the cover member 58 to the open position in accordance with the abutment.

Accordingly, the operating parts 58 can reliably be operated from outside the process cartridge 13. Further, when the process cartridge 13 is mounted in the process frame 12, the operating parts 58 pivot so that the shutter 41 moves into the open position. Hence, the operating parts 58 can be pivoted to move the shutter 41 into the open position in association with the operation for mounting the process cartridge 13.

As a result, the operating parts 58 can reliably be pivoted to move the shutter 41 into the open position in conjunction with the mounting operation for the process cartridge 13.

With the process cartridge 13 of the embodiment, when the shutter 41 is in the open position shown in FIG. 5(*b*), a large portion of the developing roller 22 and the supply roller 23 falls within the region formed by projecting the cover member 51 toward the developer unit 16. As a result, the process cartridge 13 can be made compact in the front-to-rear direction.

4. Variations of the Embodiment

While the invention has been described in detail with reference to the embodiment thereof, it would be apparent to those skilled in the art that various changes and modifications may be made therein without departing from the spirit of the invention.

For example, in the embodiment described above, the engaging parts 59 are provided on the support members 52 and the positioning grooves 75 are formed in the frame side walls 71. However, both the engaging parts 59 and the positioning grooves 75 may be omitted.

In such a case, the free ends of the operating parts 58 opposite the support parts 56 are positioned to remain in contact with the top ends of the positioning plates 74 to fix the shutter 41 in the open position when the process cartridge 13 is mounted in the process frame 12.

In the embodiment described above, the guide rails 55 are provided on the shutter 41. However, the guide rails 55 may be provided on the photosensitive drum 18 instead.

In this case, the guide rails 55 are provided on the outer circumferential surface of the photosensitive drum 18 outside the region in which a sheet of paper P passes. This construction can prevent the cover plate 53 from directly contacting the region of the photosensitive drum 18 through which a sheet of paper P passes.

What is claimed is:

1. An image forming device comprising:

a main frame;

a process frame configured to be inserted into or pulled out of the main frame; and a process cartridge detachably insertable in the process frame and comprising:

a photosensitive drum having a first rotation axis extending in an axial direction;

a developing unit disposed adjacent to the photosensitive drum and having one end and another end with respect to the axial direction;

a developing coupling provided in the one end of the developing unit for transmitting an external rotation force to the developing unit, the developing coupling having a second rotation axis extending in a direction parallel to the axial direction; and a drum shutter configured to be pivotably moved about a third rotation axis between a first position at which the drum shutter covers the photosensitive drum and a second position at which the drum shutter does not cover the photosensitive drum, the drum shutter comprising an operating portion abuttable on the process frame during insertion of the process cartridge into the process frame; and a shutter portion covering the part of the photosensitive drum at the first position, the shutter portion being in direct confrontation with the developing unit at the second position, wherein the drum shutter is configured to be moved from the second position to the first position in accordance with the abutment of the operating portion and the process frame;

wherein the second rotation axis and the third rotation axis are coaxial with each other.

2. The image forming device as claimed in claim 1, wherein the process cartridge further comprises a cartridge body, wherein the cartridge body comprises a pair of side plates opposing each other at an interval in the axial direction, the pair of the side plates rotatably supporting the photosensitive drum therebetween and supporting the developing unit and the drum shutter therebetween, each side plate having an outer major surface extending in a plane perpendicular to the axial direction, a part of the operating portion protruding outward from a contour of the major surface;

wherein the process cartridge is detachably insertable in the process frame in the inserting direction, wherein the process frame comprises a positioning plate extending in the inserting direction, the operating portion being abuttable on the positioning plate when the process cartridge is inserted into the process frame.

3. The image forming device as claimed in claim 2, further comprising an endless belt that contacts the photosensitive drum, each of the pair of side plates being positioned outside the endless belt with respect to the axial direction.

4. The image forming device as claimed in claim 2, wherein the process frame further comprises a pair of side walls spaced away from each other in the axial direction, the process cartridge being in confrontation with the pair of side walls and a positioning plate upon insertion of the process cartridge into the process frame; and wherein the operating portion is positioned inside of an imaginary space spanning between outer side surfaces of the pair of side walls upon insertion of the process cartridge into the process frame.

5. The image forming device as claimed in claim 4, wherein the process frame comprises the positioning plate, the operating portion being abuttable on the positioning plate when the process cartridge is inserted into the process frame; and, wherein the operating portion is retractable toward the developing unit from the positioning plate upon insertion of the process cartridge into the process frame.

6. The image forming device as claimed in claim 1, wherein the drum shutter further includes an engaging portion; and wherein the process frame further includes an accommodating portion that accommodates the engaging portion when the drum shutter is located at the second position to maintain the second position.

7. The image forming device as claimed in claim 1, wherein the developing unit includes a developing roller and the developing coupling provided in the one end of the developing unit is configured to transmit an external rotation force to the developing roller.

8. The image forming device as claimed in claim 1, wherein the drum shutter is configured to contact the photosensitive drum.

9. A process cartridge comprising:

a photosensitive drum rotatable about a first rotation axis extending in an axial direction;

a pair of side plates opposing each other at an interval and rotatably supporting the photosensitive drum therebetween;

a developing unit having one end and another end with respect to the axial direction and supported between the pair of the side plates;

a developing coupling provided in the one end of the developing unit for transmitting an external rotation force to the developing unit, the developing coupling having a second rotation axis extending in a direction parallel to the axial direction; and a drum shutter disposed between the pair of the side plates and pivotally movable about a third rotation axis between a first position at which the drum shutter covers the photosensitive drum and a second position at which the drum shutter does not cover the photosensitive drum, the drum shutter comprising an operating portion abuttable on the process frame during insertion of the process cartridge into the process frame, and a shutter portion covering the part of the photosensitive drum at the first position the shutter portion being in direct confrontation with the developing unit at the second position, wherein the drum shutter is configured to be moved from the second position to the first position in accordance with the abutment of the operating portion and the process frame, and wherein the second rotation axis and the third rotation axis are coaxial with each other.

10. The process cartridge as claimed in claim 9, wherein each of the pair of the side plates is spaced away from the developing unit with respect to the axial direction; and, wherein the drum shutter comprises a shutter portion covering the part of the photosensitive drum at the first position; and an arm pivotally movably supported to the developing coupling and connected to the shutter portion, the arm being positioned between the developing unit and one of the side plates.

11. The process cartridge as claimed in claim 10, further comprising a power transmission mechanism disposed at the one end of the developing unit and engaged with the developing coupling, the arm being positioned between the power transmission mechanism and one of the pair of the side plates located at the one end of the developing unit.

12. The process cartridge as claimed in claim 9, wherein each side plate has an outer major surface extending in a plane perpendicular to the axial direction; and wherein the shutter portion being positioned within a contour of the outer major surface at the first position.

13. The process cartridge as claimed in claim 9, wherein the drum shutter comprises a support section pivotally movable about the third rotation axis, a shutter portion suspended from the support section, and an operating portion extending from the support section; and wherein each side plate has an outer major surface extending in a plane perpendicular to the axial direction, at least a portion of the operating portion protruding out of a contour of the outer major surface so that the protruding portion is abuttable on an external component separate from the process cartridge, pivotal movement of the operating portion causing pivotal movement of the shutter portion to the second position in accordance with the abutment.

14. The process cartridge as claimed in claim 9, wherein the developing unit includes a developing roller and the developing coupling provided in the one end of the developing unit is configured to transmit an external rotation force to the developing roller.

15. The process cartridge as claimed in claim 9, wherein the drum shutter is configured to contact the photosensitive drum.

* * * * *